United States Patent [19]

Clemensen

[11] 4,078,355

[45] Mar. 14, 1978

[54] APPARATUS AND METHOD OF APPLYING INSULATION TO THE WALL OF A BUILDING STRUCTURE

[76] Inventor: Carl L. Clemensen, P.O. Box 12090, Wichita, Kans. 67212

[21] Appl. No.: 693,348

[22] Filed: Jun. 7, 1976

[51] Int. Cl.[2] ..... E04B 1/00; E04B 2/60

[52] U.S. Cl. ..... 52/747; 52/222; 52/478; 52/665; 52/749; 242/86.52

[58] Field of Search ..... 52/741, 743, 63, 222, 52/749, 273, 478, 90, 665, 748, 747; 222/154, 160; 160/1, 5, 6, 84 R, 23 R; 242/86.52

[56] References Cited

U.S. PATENT DOCUMENTS

| | | | |
|---|---|---|---|
| 987,593 | 3/1911 | O'Maley | 242/86.52 |
| 2,439,681 | 4/1948 | Ankney | 242/86.52 |
| 2,923,487 | 2/1960 | Wands et al. | 242/86.52 |
| 3,398,491 | 8/1968 | Babcock | 52/741 |
| 3,559,914 | 2/1971 | Alderman | 242/86.52 |
| 3,766,958 | 10/1973 | Mitchell | 160/1 |
| 3,969,863 | 7/1976 | Alderman | 52/407 |

FOREIGN PATENT DOCUMENTS

| | | | |
|---|---|---|---|
| 550,745 | 9/1956 | Belgium | 242/86.52 |
| 600,815 | 12/1959 | Italy | 242/86.52 |
| 997,880 | 7/1965 | United Kingdom | 242/86.52 |

*Primary Examiner*—Price C. Faw, Jr.
*Assistant Examiner*—Robert C. Farber
*Attorney, Agent, or Firm*—Edwin H. Crabtree; John H. Widdowson

[57] ABSTRACT

A method and apparatus for applying insulation material to the sidewalls and endwalls of a building structure. The apparatus is disposed parallel and adjacent to the top of the wall. A roll of insulating material is mounted on the apparatus and fed downward along the side of the building wall and parallel thereto. The end of the insulating material is attached to the bottom of the wall and the insulating material is tightened and held in place by a tension means which is part of the apparatus. The insulating material is then attached to the top of the wall and cut free from the remaining insulating material on the roll. The apparatus is then moved along the top of the wall to a position where the insulating material can be fed downward adjacent to the attached insulating material. The method is then repeated.

10 Claims, 5 Drawing Figures

APPARATUS AND METHOD OF APPLYING INSULATION TO THE WALL OF A BUILDING STRUCTURE

BACKGROUND OF THE INVENTION

This invention relates generally to an apparatus and method for applying insulation material to a building structure and more particularly but not by way of limitation to an apparatus and method for applying insulation material to the walls of a building structure.

Heretofore, there have been various types of devices used for applying roofing material to a building structure. Recently an apparatus was introduced which supports a roll of insulating material thereon and is guided between support members of a roof structure. The apparatus applies the insulation material between the support members. None of the prior art roofing devices have dealt with the problem of applying insulating material to the walls of the building.

At the present time insulation material is unrolled on the building floor or ground and cut to the length necessary to fit the building structure from the floor to the eave strut. Applying insulation in this fashion is dangerous particularly since workmen are holding the material on the edge of the top of the wall and often if there is a wind it is very difficult if not impossible to hold the insulation material securely against the side of the building wall. This method of applying insulation material many times leaves the insulation material facing dirty or muddy and gives the wall structure an unsightly appearance when installed.

The subject invention provides a novel apparatus and method for applying insulation and eliminates the above described problems in securing insulation to the wall of a building structure.

SUMMARY OF THE INVENTION

The subject invention eliminates applying insulation material by hand to the wall of a building structure.

The apparatus for applying insulation to the wall holds the insulation material in tension against the side of the wall thereby allowing the insulation to be secured tightly against the sides of the building wall.

The invention allows insulation material to be applied to the wall of the building structure during a windy condition.

The invention greatly reduces the labor required in applying insulation material to the wall of the building since the insulation material is supported on the apparatus and tightened thereon.

The apparatus and method for applying insulation improves the efficiency of building construction thereby reducing construction costs to the owner.

The apparatus for applying insulation material to the wall of a building structure includes a frame having support means mounted thereon for supporting a roll of insulation material. The frame includes a front portion and a rear portion. The front portion of the frame is disposed parallel and adjacent to the top of the wall of the building structure. The frame is mounted on guide rollers which are moved along the top of the wall. A tension means is mounted on the front of the frame for receiving one end of the insulation material therethrough. The end of the insulation material is fed parallel to the wall of the building structure and is attached to the bottom of the wall. The insulating material is then tightened by the tension means and held in place while the insulation material is attached at the top of the wall.

The advantages and objects of the invention will become evident from the following detailed description when read in conjunction with the accompanying drawings which illustrate the preferred embodiments of the invention.

DETAILED DESCRIPTION OF THE DRAWINGS

Figure 1:
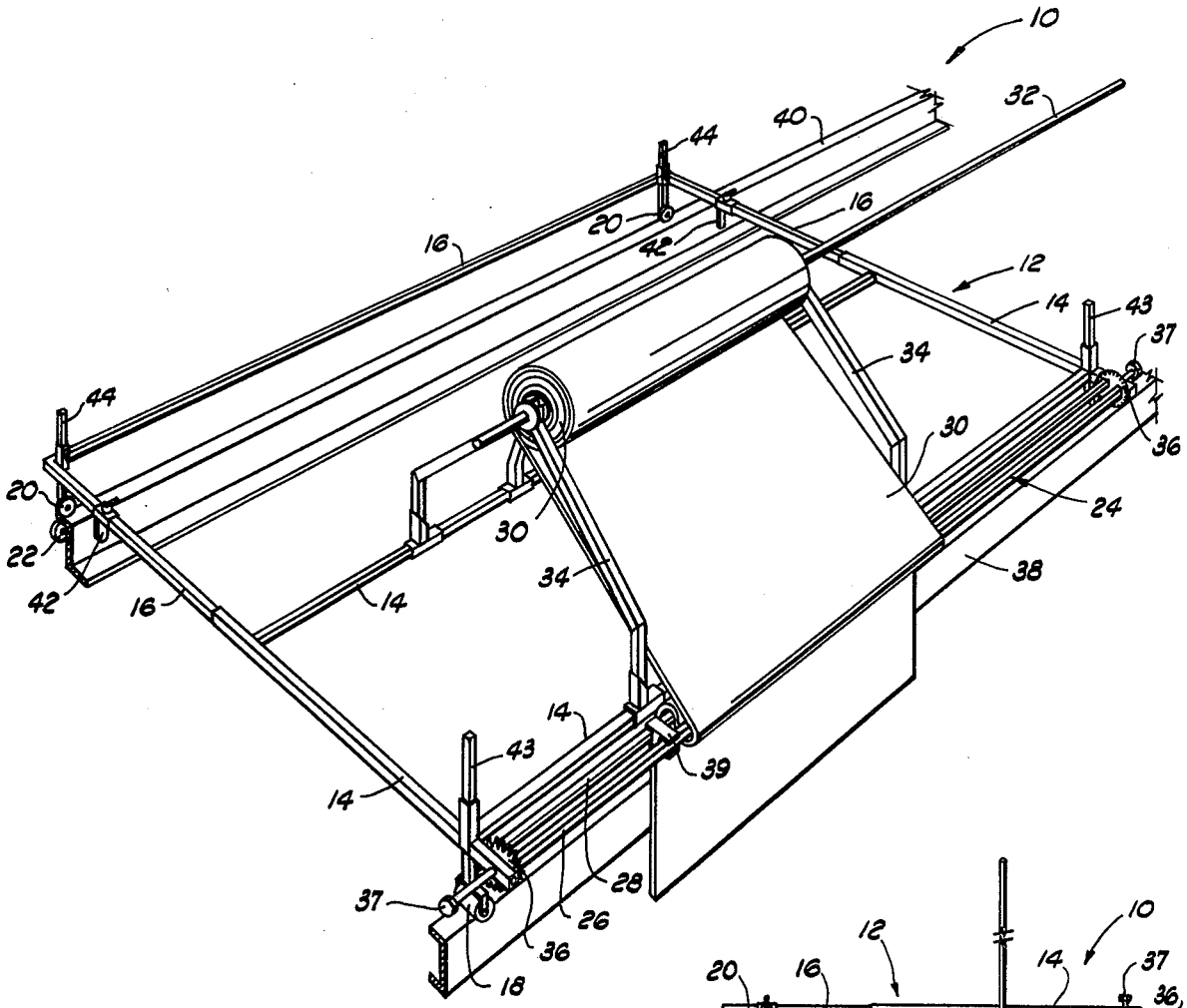
FIG. 1 is a perspective view of the apparatus for applying insulation material to the wall of a building structure.

In FIG. 1 the apparatus for applying insulation to a wall of a building structure is designated by general reference numeral 10. It should be noted that during the discussion of the apparatus 10, the wall of the building structure is not a wall per se but an open wall structure formed by metal beams used to construct the building. The apparatus 10 includes a frame 12 having a front portion 14 and a rear portion 16, a pair of front guide rollers 18 mounted on the corners of the front portion 14 and a pair of vertically disposed rear guide rollers 20 and 22 mounted to the corners of the rear portion 16.

A tension reel 24 is rotatably attached to the front portion 14. The tension reel 24 includes a pair of elongated parallel bars 26 and 28 disposed in a spaced relationship to each other for receiving one end of a roll of insulation material 30. The roll of insulation material 30 is mounted on a support bar 32. The bar 32 is supported at both ends by a pair of side frames 34. The side frames 34 are slidably attached to the front portion 14 of the frame 12 and foldable thereon for ease in storage and shipping. The tension reel 24 further includes a ratchet assembly 36 mounted at both ends of the reel 24. The ratchet assembly 36 is used for tightening the insulation material 30 around the parallel bars 26 and 28 and holding the bars 26 and 28 and the insulating material 30 in place while the insulating material 30 is attached to the wall of the building.

A ratchet bolt 37 extends outwardly from the ratchet assembly 36. The bolt 37 may be used for providing additional tension on the insulating material 30 by turning the bolt 37 clockwise with a tool.

Disposed between the parallel bars 26 and 28 is a bar spreader 39 which is slidably attached thereto to keep the parallel bars 26 and 28 in their spaced relationship to each other as the insulation material 30 is tightened therearound.

In this view the front portion 14 of the frame 12 can be seen mounted on an eave strut 38. The eave strut 38 is positioned at the top of the wall of the building structure and receives the guide rollers 18 thereon. The vertically disposed rear guide rollers 20 and 22 are guided on a purlin 40 with an upper edge of the purline 40 received therebetween. The purlin 40 runs parallel to the eave strut 38.

The rear portion 16 of the frame 10 includes a pair of slidable locking devices 42 which are adjusted against the side of the purlin 40. The upper edge of the purlin 40 is disposed between the rear guide rollers 20 and 22 and the locking device 42. The pair of locking devices 42 prevent the apparatus 10 from rotating counterclockwise on the roof of the building structure should there be an unbalance of weight when the roll of insulating material 30 is mounted on the frame 12 or during a windy condition which may try to blow the frame 12 and insulating material 30 off the building structure.

Also seen in FIG. 1 is the rear portion 16 of the frame 12 slidably received in the front portion 14 of the frame 12. The rear portion 16 is adjustable with the front portion 14 so that the frame 12 can be adjusted on eave struts and purlins having various widths therebetween.

The front guide rollers 18 are mounted at the end of a first adjustable vertical bar 43 slidably mounted on the corners of the front portion 14 of the frame 12. Also the rear guide rollers 20 and 22 are mounted at the end of a second adjustable vertical bar 44 slidably mounted at the corners of the rear portion 16 of the frame 12. By loosening bar clamps 46 shown in FIG. 2 which are attached to the front portion 14 and rear portion 16 of the frame 12, the vertical bars 43 and 44 can be adjusted upwardly or downwardly on the eave strut 38 and purlin 40 thereby allowing the front portion 14 of the frame 12 to be positioned horizontally on a sloping roof structure.

Figure 2:
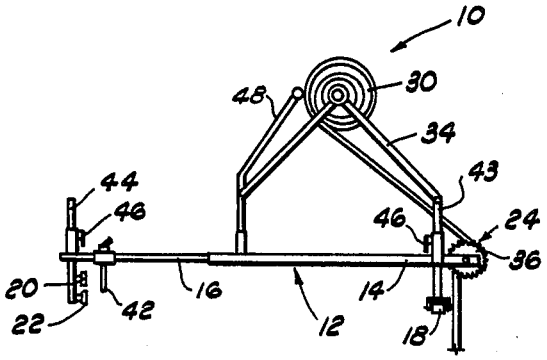
FIG. 2 is a side view of the apparatus.

In FIG. 2 a side view of the apparatus 10 can be seen. In this view a tension arm 48 can be seen biased against the side of the insulation roll 30 mounted on the support bar 32. The tension arm 48 is slidably attached to the front portion 14 of the frame 12 and is biased in a clockwise direction against the roll of insulation material. The arm 48 prevents the insulation material 30 from becoming unrolled should a gust of wind try to unravel the roll while the end of the insulating material 30 is being fed through the tension reel 24 and downward along the wall of the building structure.

Also seen in this view is the tension reel 24 disposed in front of the front portion 14 of the frame 12. In this position the tension reel 24 is disposed parallel to and adjacent the length of the eave strut 38 for receiving one end of the insulation material 30 therethrough.

Figure 3:
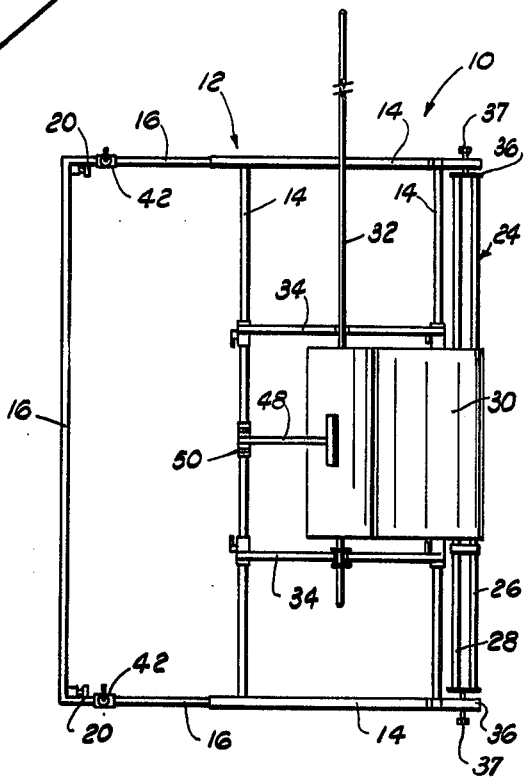
FIG. 3 is a top view of the apparatus.

In FIG. 3 a top view of the apparatus 10 is illustrated. In this view a coil spring 50 can be seen disposed around the base of the tension arm 48 for urging the tension arm 48 against the roll of insulating material 30. Also seen is the angular shape of the frame 12 with the rear portion 16 slidably attached to the front portion 14 of the frame 12.

Figure 4:
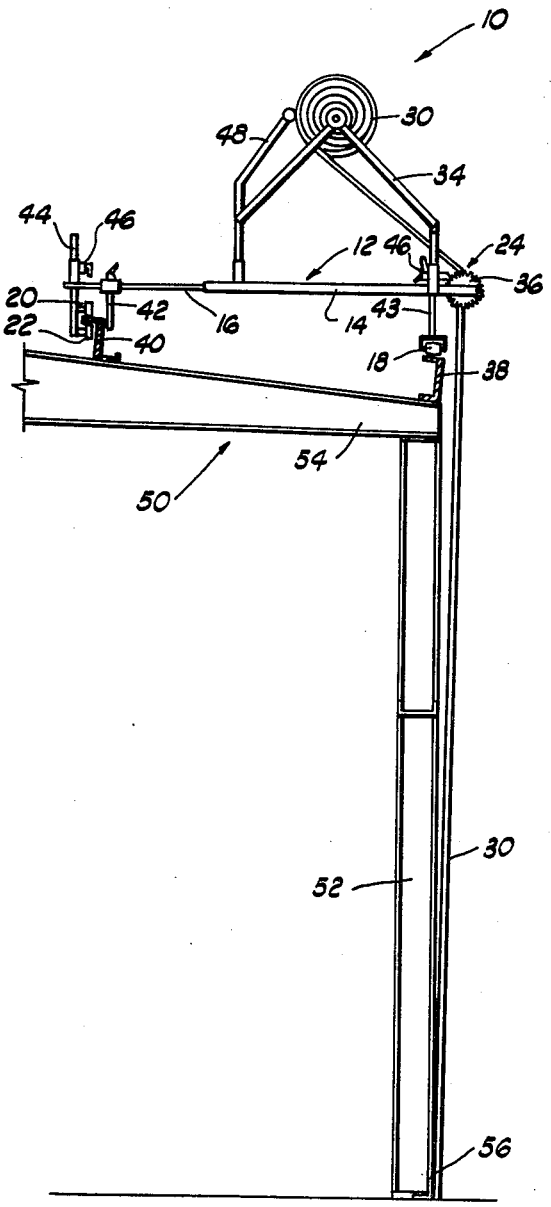
FIG. 4 is a side view of the apparatus applying insulation material along the wall of the building structure.

In FIG. 4 a portion of a building structure 50 is illustrated having a vertical wall beam 52 which is a portion of the sidewall of the building structure 50 and a horizontal roof beam 54 having one end disposed on top of the vertical beam 52 and supporting the eave strut 38 and purlin 40 thereon. In this figure the roll of insulating material 30 can be seen having one end fed through the tension reel 24 and downward along the side of the vertical beam 52. The insulating material 30 is fed down to a bottom portion 56 of the vertical beam 52 and attached thereto.

Figure 5:
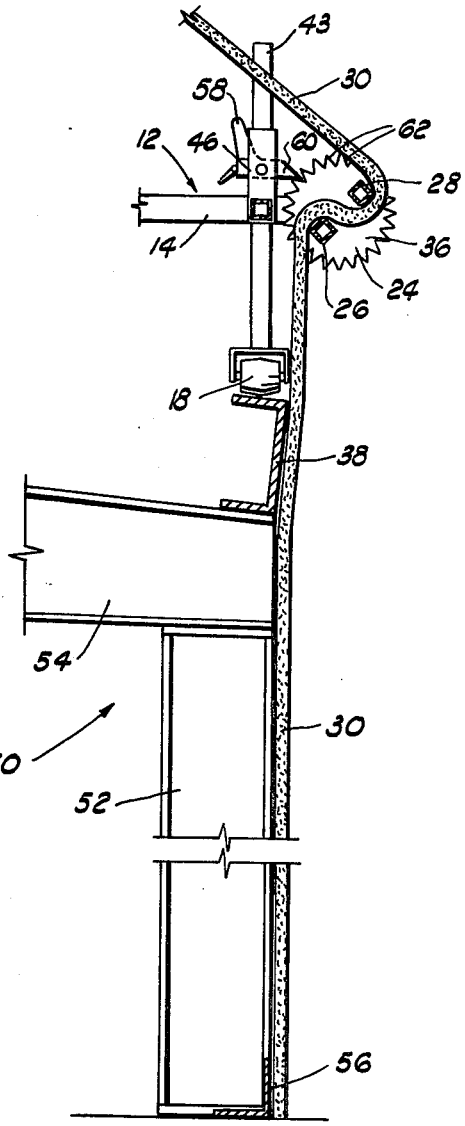
FIG. 5 is an enlarged sectional side view of a portion of the apparatus illustrating the tension means tightening the insulation material as it is applied to the wall of the building structure.

In FIG. 5 an enlarged sectional side view of a portion of the frame 12 is shown. In this view the tension reel 24 has received the end of the insulating material 30 therethrough and the insulating material has been fed downward along the vertical beam 52 and attached to the bottom portion 56. The insulating material 30 is now tightened by rotating the tension reel 24. As the tension reel 24 is rotated in a clockwise direction the insulating material 30 is wrapped around the elongated parallel bars 26 and 28 until the insulating material 30 is held tightly in tension against the sides of the vertical beam 52, the end of the horizontal beam 54, and against the sides of the eave strut 38. The insulating material 30 is held in place around the parallel bars 26 and 28 by the ratchet assembly 36 coacting with a ratchet latch 58 which has an end portion 60 which mates with the ratchet assembly teeth 62. The ratchet latch 58 allows the tension reel 24 to be rotated in a clockwise direction but prevents it from moving in a counterclockwise direction thereby holding the insulating material 30 in tension and in place against the wall of the building structure 50 until the insulating material 30 is attached to the eave strut 38. The remaining insulating material 30 supported on the frame 12 is then cut free.

In operation the apparatus 10 is lifted onto the top of the building structure 50. The front portion 14 and the rear portion 16 of the frame 12 are adjusted between the eave strut 38 and the purlin 40 so that the front guide rollers 18 ride along the length of the eave strut 38 and the rear guide rollers 20 and 22 on the rear portion 16 of the frame 12 ride between the upper edge of the purlin 40.

Should the roof structure of the building 50 have a slope it is necessary to have the front portion 14 of the assembly 10 positioned horizontally so that the insulating material 30 can be fed downward in a vertical position along the side of the wall of the building 50. If this is the case the bar clamps 46 are loosened and the first and second adjustable vertical bars 43 and 44 are adjusted either upwardly or downwardly to level the front portion 14 horizontally.

When the guide rollers 18, 20 and 22 have been positioned on the eave strut 38 and purlin 40, the locking devices 42 are adjusted against the side of the purlin 40 to hold the frame 12 in place on the purlin 40.

At this time the side frames 34 are raised vertically on the front portion 14 of the frame 12 and the support bar 32 with a roll of insulating material 30 therearound is placed between the side frames 34 and supported thereon.

The end of the roll of insulating material 30 is now unrolled and fed between the elongated bars 26 and 28 of the tension reel 24. The insulating material 30 is then fed downward along the side of the wall of the building structure 50 until it reaches the bottom portion 56 of the vertical beam 52. The end of the insulating material 30 is then attached to the bottom portion 56. When the end of the insulating material 30 has been attached, the tension reel 24 is rotated in a clockwise direction, thereby winding the insulating material 30 around the parallel bars 26 and 28 and tightening the insulating material 30. The insulating material 30 is prevented from compressing the elongated bars 26 and 28 together by the bar spreader 39.

The tension reel 24 can be rotated clockwise by hand or by using a tool for turning the ratchet bolt 37. As the insulating material 30 is tightened on the reel 24 the insulating material 30 is moved inward against the sides of the wall and is held in tension by the ratchet assembly 36. The insulating material can now be attached to any intermediate structural member between the bottom portion 56 of the vertical beam 52 and the eave strut 38. The insulating material is now attached to the eave strut 38 and the remaining insulation 30 is unlatched from the tension reel 24 and the roll is cut free from the attached insulation material 30.

The method of attaching the insulating material 30 to the wall of the building structure 50 is now repeated by rolling the apparatus 10 along the length of the eave strut 38 and purlin 40 until the insulating material 30 is positioned adjacent to the previously installed insulating material 30. The insulating material 30 is now fed again through the tension reel 24, downward along the wall of the building structure 50 and positioned adjacent and tangent to the previously attached insulation material 30.

While the insulating material 30 is being attached to the wall structure of the building structure 50 an outside wall sheet which is not shown in the drawings overlays the insulating material 30 and is secured simultaneously to the building structure 50 with screw fasteners.

Changes may be made in the construction and arrangement of the parts or elements of the embodiments as disclosed herein without departing from the spirit or scope of the invention as defined in the following claims.

I claim:

1. An apparatus mounted on the top of a building structure for applying insulation to a wall of the structure, the apparatus comprising:

an angular shaped frame having support means mounted thereron for rotatably supporting a roll of insulating material parallel to the wall, said frame having a front portion and a rear portion, the front portion of said frame disposed parallel and adjacent the top of the wall, the front portion of said frame adjustably mounted to the rear portion of said frame so that the width of said frame can be adjusted to the width between spaced apart support members on the top of the building structure;

guide means mounted on the front portion and rear portion of said frame, said guide means disposed on the spaced apart support members of the top of the building structure; and tension means rotatably mounted on the front portion of said frame for receiving one end of the insulating material therethrough and tightening the insulating material therearound, and holding the insulating material in tension against the wall of the structure when one end of the insulating material is secured to the wall of the structure.

2. A method of applying insulating material to a wall of a building structure, the steps comprising:

supporting a roll of insulating material on support means, said support means mounted on an angular shaped frame, said frame having a front portion and a rear portion, the front portion of said frame adjustably mounted to the rear portion of said frame, the front portion of said frame disposed parallel and adjacent the top of the wall of the building structure;

feeding one end of the roll of insulating material through tension means rotatably mounted on the front portion of said frame and feeding the insulating material downward and parallel to the wall of the building structure;

attaching the end of the insulating material to the bottom of the wall of the building structure;

tightening the insulating material on said tension means and against the wall of the building structure; and attaching the tightened insulating material to the top of the wall of the building structure.

3. The method as described in claim 2, further including the step of adjusting the width of said frame by adjusting the front portion of said frame to the rear portion of said frame so that said frame can be supported between spaced apart support members on the top of the building structure.

4. The method as described in claim 3, further including the step of guiding said frame on top of the spaced apart support members on the top of the building structure by guide means mounted on the front portion and rear portion of said frame, said guide means disposed on the spaced apart support members on the top of the building structure.

5. The apparatus as described in claim 1, wherein said frame further includes an upwardly extending tension arm mounted on the front portion of said frame and biased against the side of the roll of insulation material.

6. The apparatus as described in claim 1, wherein said tension means includes a pair of elongated parallel bars rotatably mounted on the front portion of said framework and including a ratchet assembly mounted at one end thereof, said parallel bars disposed in a spaced relationship for receiving one end of the insulating material therethrough, said ratchet assembly holding said parallel bars in place when the insulating material has been tighten therearound.

7. The apparatus as described in claim 1, wherein said guide means are guide rollers mounted on the front and rear portion of said frame and disposed on spaced apart support members of the top of the building structure.

8. The apparatus as described in claim 7, wherein said guide rollers mounted on the rear portion of said frame include a pair of guide rollers mounted at each corner of the rear portion of said frame and vertically disposed one on top of the other, said vertically disposed guide rollers receiving a portion of the support member therebetween for guiding said frame thereon.

9. The apparatus as described in claim 1, wherein said support means includes a pair of upstanding side frames and a support bar supported at the ends by said side frames, said support bar rotatably mounted on said side frames and receiving a roll of insulating material thereon.

10. The apparatus as described in claim 9, wherein the upstanding side frame members are adjustable along the length of the front portion of said frame.

* * * * *